US005327860A

United States Patent [19]

Krüger

[11] Patent Number: 5,327,860

[45] Date of Patent: Jul. 12, 1994

[54] HYDRAULIC TAPPET-CLEARANCE COMPENSATING ARRANGEMENT FOR A CAM-CONTROLLED VALVE LIFTER

[75] Inventor: Hermann Krüger, Wolfsburg, Fed. Rep. of Germany

[73] Assignee: Volkswagen AG, Wolfsburg, Fed. Rep. of Germany

[21] Appl. No.: 131,711

[22] Filed: Oct. 5, 1993

[30] Foreign Application Priority Data

Oct. 14, 1992 [DE] Fed. Rep. of Germany ..... 4234573

[51] Int. Cl.[5] ..... F01L 1/24; F01L 1/14; F15B 15/24

[52] U.S. Cl. ..... 123/90.55; 123/90.48; 74/569

[58] Field of Search ..... 123/90.48, 90.49, 90.5, 123/90.55, 90.57; 74/569

[56] References Cited

U.S. PATENT DOCUMENTS

| | | | |
|---|---|---|---|
| 3,728,990 | 4/1973 | Lampredi et al. | 123/90.56 |
| 4,802,448 | 2/1989 | Ableitner | 123/90.55 |
| 4,807,575 | 2/1989 | Litwinchuk et al. | 123/90.55 |
| 4,867,113 | 9/1989 | Pieprzak et al. | 123/90.55 |
| 4,986,166 | 1/1991 | Shida | 123/90.55 |
| 5,005,541 | 4/1991 | Yamamoto et al. | 123/90.55 |

FOREIGN PATENT DOCUMENTS 2843918 12/1980 Fed. Rep. of Germany .

*Primary Examiner*—E. Rollins Cross
*Assistant Examiner*—Weilun Lo
*Attorney, Agent, or Firm*—Brumbaugh, Graves, Donohue & Raymond

[57] ABSTRACT

A hydraulic tappet-clearance compensating arrangement having no check valve includes an outer cylinder formed with a cup tappet and a piston axially displaceable in the outer cylinder and forming a pressure chamber therein. The outer cylinder is formed with a through-hole and a channel axially positioned so that a flow connection for the pressure medium is provided between the pressure chamber and a reservoir only during the base circle phase of the valve-operating cam and a flow connection is provided between the reservoir and a pressure medium supply only outside the base circle phase of the cam.

7 Claims, 2 Drawing Sheets

HYDRAULIC TAPPET-CLEARANCE COMPENSATING ARRANGEMENT FOR A CAM-CONTROLLED VALVE LIFTER

BACKGROUND OF THE INVENTION

This invention relates to a hydraulic tappet-clearance compensating arrangement for cam-controlled valve lifters.

Conventional hydraulic tappet-clearance compensating arrangements, which are used at various locations in actuators for valve lifters for intake and exhaust valves in internal combustion engines, include a check valve which normally has a movable valve body such as a ball with a compression spring acting on it. This conventional check valve design takes up a relatively large amount of space in the tappet-clearance compensating arrangement whereas, for reasons of limited space and for the purpose of reducing the moving masses of the valve actuator, the tappet-clearance compensating arrangement should be especially compact. Even when a departure has been made from the ball valve design for the check valves in hydraulic tappet-clearance compensating arrangements, as, for example, in the arrangement shown in U.S. Pat. No. 3,728,990 by the use of a discoid valve member, the check valve, which is loaded against spring resistance by the pressure of a pressure medium normally diverted from the oil supply of the engine, provides an element of uncertainty. Therefore, a design for a hydraulic tappet-clearance compensating arrangement which does not use such a check valve would be advantageous.

German Patent No. 28 43 918 describes a design for a hydraulic tappet of a valve actuator for an internal combustion engine wherein the check valve is provided by a spring-loaded sealing element which is forcibly actuatable by an additional track designed on the cam. Specifically, this arrangement provides a cup-shaped spring-loaded tappet piston surrounding a reservoir for pressure medium and disposed between two piston-like end pieces which are axially displaceable in an outer cylinder, defining a pressure chamber which accommodates a compression spring between the end of the tappet piston on one side and one of the end pieces on the other. Accordingly, in this arrangement, all of the parts accommodated by the outer cylinder, i.e., the end pieces and tappet piston, are carried within the outer cylinder and are axially displaceable relative thereto. In the wall of the tappet piston and in the outer cylinder, there are provided recesses and through-holes which, on the one hand, establish a connection between the reservoir and the pressure-medium supply at all positions of the outer cylinder with respect to the parts accommodated by it and, on the other hand, ensure a connection between the reservoir and pressure chamber only at a selected relative axial position of the tappet piston with respect to the outer cylinder. This relative axial position between the tappet piston and outer cylinder is established by an additional cam track which displaces the outer cylinder against spring resistance relative to the piston during the base circle phase of the cam. The additional cam track is shaped so that, outside the base circle phase of the cam, the spring resistance displaces the outer cylinder relative to the piston, which is disposed in the path of the transmission of force between cam and valve, into a relative axial position in which the flow connection is interrupted.

As demonstrated by this explanation of the conventional arrangement, it is not very suitable for mass production because of its incorporation of many components which must be movable relative to one another while preserving tightness and because of its complicated cam shape.

SUMMARY OF THE INVENTION

Accordingly, it is an object of the present invention to provide a hydraulic tappet-clearance compensating arrangement for a cam-controlled valve lifter which overcomes the disadvantages of the prior art.

Another object of the invention is to provide such a hydraulic tappet-clearance compensating arrangement while preserving the advantageous avoidance of check valves so that the manufacturing expenditure, the moving masses and the component costs are considerably reduced.

These and other objects of the invention are attained by providing a tappet-clearance compensating arrangement having an axially displaceable outer cylinder including a transverse wall forming a cup tappet and having a through opening in a peripheral wall which communicates with a pressure medium reservoir only in the base circle phase of a valve-lifting cam and a piston axially displaceable in the outer cylinder and forming a pressure chamber in conjunction with the transverse wall of the outer cylinder.

A particular advantage of the invention is that it accomplishes the basic object of avoiding check valves in a markedly simple fashion by an arrangement that, in principle, contains only two parts which are axially movable relative to one another, i.e., the outer cylinder containing the cup tappet and the piston. Appropriate arrangement and design of flow channels or flow connections in the cup tappet and in a guide opening for the outer cylinder, which is formed, for example, in a cylinder head of an internal combustion engine, assures that the pressure chamber is connected with the reservoir only during the base circle phase and that the reservoir is connected with the pressure medium supply only outsided the base circle phase of the valve-driving cam. Thus, it is not necessary to provide a cam with an additional cam track.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figure 2:
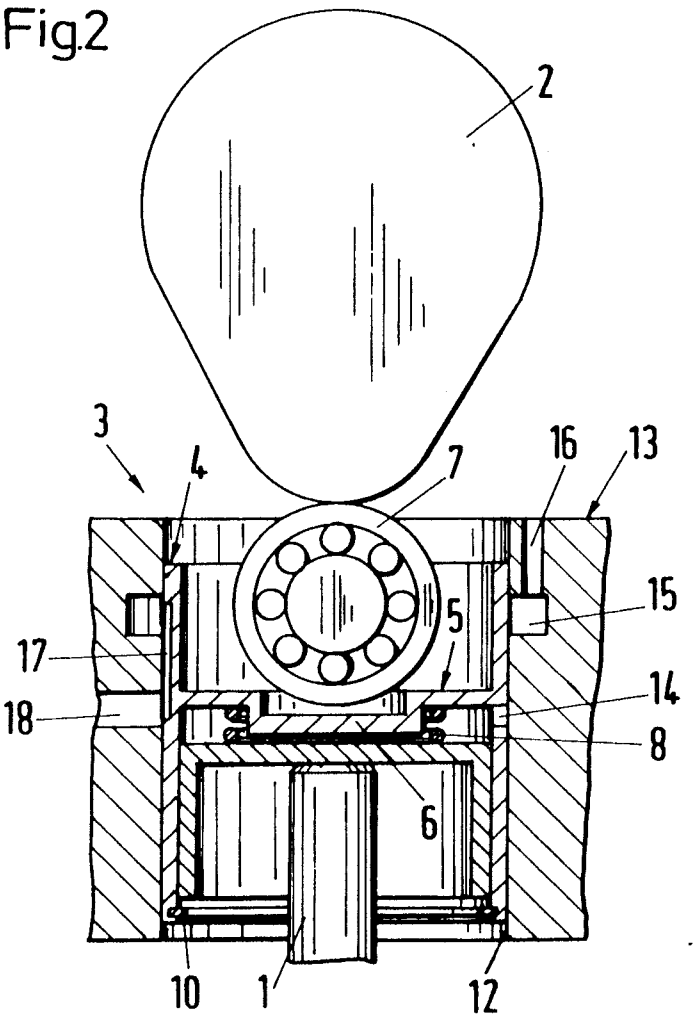
FIG. 2 is an axial sectional view showing the arrangement of FIG. 1 with the valve-lifting cam in its lifting phase.
Figure 1:
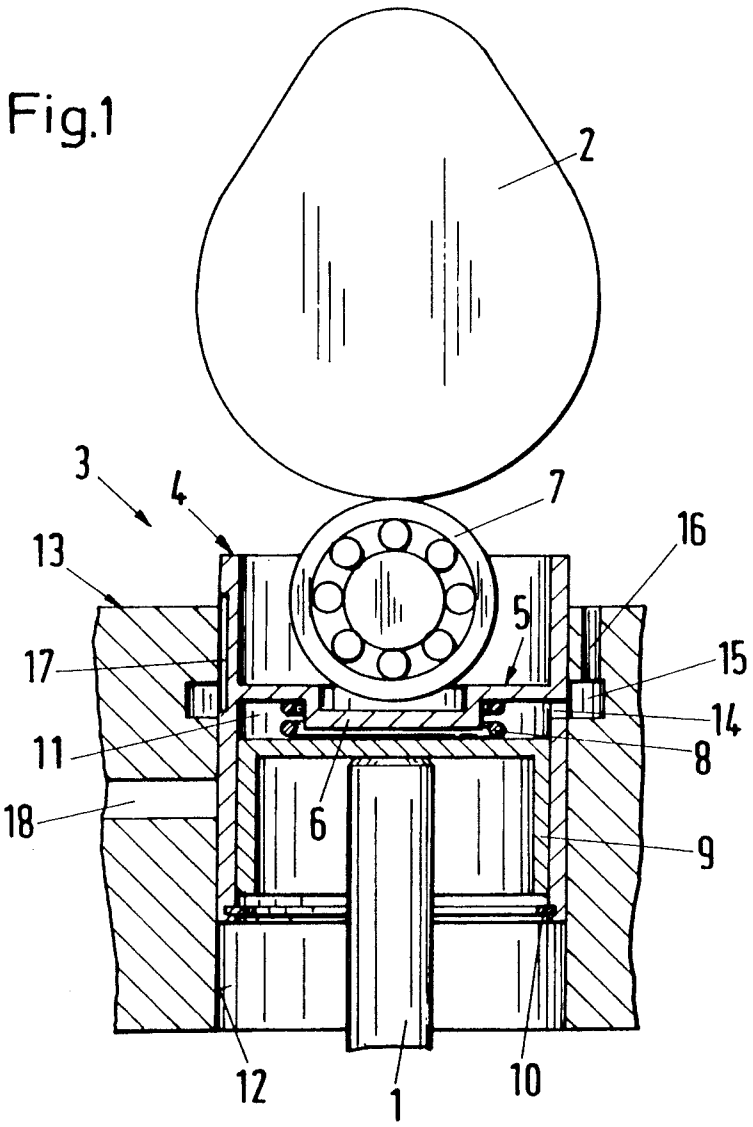
FIG. 1 is an axial sectional view illustrating a representative hydraulic tappet-clearance compensating arrangement in accordance with the invention with the valve-lifting cam in its base circle phase.

In the representative embodiment of the invention shown in the drawings, a valve 1, of which only the stem is shown in the drawings, is urged upwardly as seen in FIGS. 1 and 2 toward its closed position, in the usual fashion for the intake and exhaust valves of internal combustion engines, by a valve-closing spring, not shown. A cam 2, driven by the engine in the usual manner, moves the valve 1 in the opposite direction, i.e., in the direction to open the valve. The valve-lifting force applied by the cam is transmitted linearly through a hydraulic tappet-clearance compensating device 3 to the valve 1 so that variations in tappet clearance, which are produced for a variety of reasons, are compensated. This compensating device 3 contains two main components, i.e., a cup tappet casing 4 with a transverse wall 5 formed in one piece with the cup tappet casing and a cuplike piston 9 in which the valve 1 is supported. The wall 5 has a central offset portion 6 to accommodate a power-transmission roller 7 mounted in the cup tappet 4 and to form a guide for a compression spring 8. A pressure chamber 11 is formed between the transverse wall 5 and the adjacent wall of the piston 9, the piston being supported for axial motion, limited by a stop ring 10, in the cup tappet casing 4.

The cup tappet casing 4 ids supported for axial motion, but fixed against rotation, by a guide opening 12 formed in a cylinder head 13 of the engine which contains the valve 1.

Considering first the relationships of the elements during the base circle phase of the cam 2 as shown in FIG. 1, a through-hole 14 adjacent to the transverse wall 5 in the cup tappet casing 4 is aligned with an annular reservoir 15 which leads to a vent 16. Although the reservoir 15 is in the cylinder head 13 in the illustrated embodiment, it could alternatively be formed within the cup tappet casing 4 and the through-hole 14 could be connected to it at the proper time by an appropriate channel formed in the guide opening 12. The axial spacing between the transverse wall 5 and the wall of the piston 9 is controlled by the pressure of the pressure medium during the base circle phase of the cam 2 so as to correspond to the tappet clearance existing at any given time.

Figure 3:
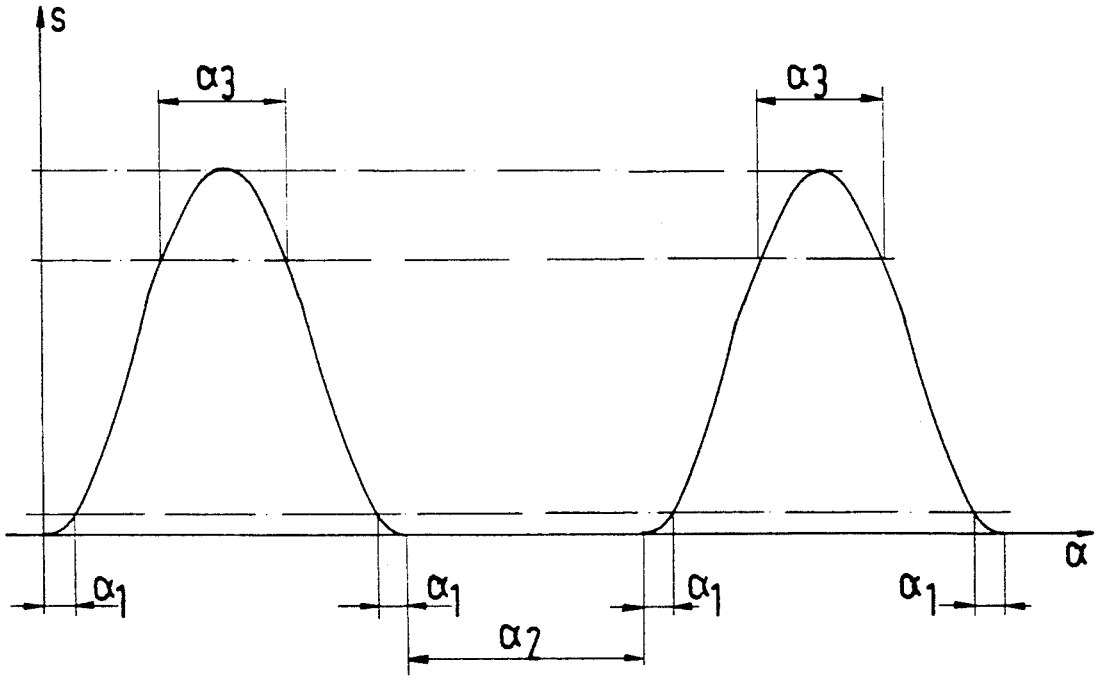
FIG. 3 is a graphical representation of valve lift versus cam angle, showing cam angle ranges during which certain components of the compensating arrangement have a described relationship.

In the graph of FIG. 3, which shows the variation of valve lift s with respect to cam angle $\alpha$, the cam angle range in which the through-hole 14 is open to the reservoir 15 is labelled $\alpha_2$.

As soon as the cam 2 begins to move the cup tappet casing 4 in the direction to open the valve, the through-hole 14 begins to move downwardly form the position shown in FIG. 1, and a pressure buildup occurs in the pressure chamber 11 during a crank angle range $\alpha_1$ shown in FIG. 3 until the opening 14 is covered by the wall of the guide opening 12. This causes some of the pressure medium in the pressure chamber 11 to flow back into the reservoir 15. However, since the quantity of pressure medium which flows back to the reservoir is very small, the resulting reduction in valve lift likewise remains very small.

Since the through-hole 14 is covered during the remainder of the valve lift curve, further flow of pressure medium back to the reservoir is prevented. As illustrated in FIG. 2, however, as soon as a channel 17 formed in the outer surface of the cup tappet casing 4 has established a connection between the reservoir 15 and a pressure medium supply 18, transfer of pressure medium into the reservoir 15 occurs during a cam angle range $\alpha_3$, shown in FIG. 3. Air contained in the reservoir 15, for example, are carried along with the pressure medium, may, if present, escape through the vent opening 16; otherwise, a slot between the cup tappet casing 4 and the guide opening 12 may be provided for this purpose.

In connection with the discharge of air, it is advantageous to provide the through-hole 14 at the upper end of the pressure chamber 11, i.e., immediately beneath the transverse wall 5, as shown in the drawings. It is likewise advantageous to position the reservoir 15 so that the control opening 14 communicates only with the lower region of the same, as shown in FIG. 1, because the oil at that location contains the least air.

As illustrated in the diagram of FIG. 3, the pressure chamber 11 is in flow communication with the reservoir 15 only during the cam angle range $\alpha_2$, and the reservoir 15 is in flow communication with the pressure medium supply 18 only during the cam angle range $\alpha_3$. This means that, during the actual clearance-compensating interval, i.e., when the cam is driving the valve, the tappet-clearance compensating arrangement is sealed from the atmosphere.

Accordingly, the invention provides a hydraulic tappet-clearance compensating arrangement which is distinguished by especially small size and hence by an especially small moving mass.

Although the invention has been described herein with reference to a specific embodiment, many modifications and variations therein will readily occur to those skilled in the art. Accordingly, all such variations and modifications are included within the intended scope of the invention.

I claim:

1. A hydraulic tappet-clearance compensating arrangement for a cam-controlled valve lifter comprising an outer cylinder guided for axial displacement in response to operation of a cam, a piston axially displaceable in the outer cylinder, a transverse wall fixed in the outer cylinder forming a cup tappet and providing a hydraulic pressure chamber in conjunction with the piston, a compression spring disposed between the piston and the transverse wall, a reservoir for a hydraulic pressure medium supplied from an external pressure medium supply, a pressure medium control opening in the outer cylinder communicating with the pressure chamber and positioned to communicate with the reservoir only during the base circle phase of the cam, and a channel formed in the outer cylinder and providing communication between the reservoir and the external pressure medium supply only outside the base circle phase of the cam.

2. A hydraulic tappet-clearance compensating arrangement according to claim 1 wherein the reservoir is formed in a cylinder head having an opening in which the outer cylinder is guided for axial displacement.

3. A hydraulic tappet-clearance compensating arrangement according to claim 1 including a central offset portion formed in the transverse wall and directed toward the piston, and a roller mounted in the cup tappet on the opposite side of the transverse wall from the piston.

4. A hydraulic tappet-clearance compensating arrangement according to claim 3 wherein the central offset portion forms a support for the compression spring.

5. A hydraulic tappet-clearance compensating arrangement according to claim 1 including a vent communicating with the reservoir.

6. A hydraulic tappet-clearance compensating arrangement according to claim 1 wherein the control opening is provided at the end of the pressure chamber adjacent to the transverse wall.

7. A hydraulic tappet-clearance compensating arrangement according to claim 1 wherein the control opening communicates with only a lower region of the reservoir during the base circle phase of the cam.

* * * * *